US010226109B1

(12) United States Patent
Calder

(10) Patent No.: US 10,226,109 B1
(45) Date of Patent: Mar. 12, 2019

(54) BAG ATTACHMENT ASSEMBLY

(71) Applicant: Curtis M. Calder, New York, NY (US)

(72) Inventor: Curtis M. Calder, New York, NY (US)

( * ) Notice: Subject to any disclaimer, the term of this patent is extended or adjusted under 35 U.S.C. 154(b) by 147 days.

(21) Appl. No.: 15/157,522

(22) Filed: May 18, 2016

Related U.S. Application Data

(60) Provisional application No. 62/162,941, filed on May 18, 2015.

(51) Int. Cl.

| | |
|---|---|
| ***B65D 33/06*** | (2006.01) |
| ***A45C 13/02*** | (2006.01) |
| ***A45C 1/02*** | (2006.01) |
| ***A45C 3/06*** | (2006.01) |
| ***A45C 13/10*** | (2006.01) |
| ***A45C 13/30*** | (2006.01) |

(52) U.S. Cl.
CPC ..... *A45C 13/02* (2013.01); *A45C 1/02* (2013.01); *A45C 3/06* (2013.01); *A45C 13/10* (2013.01); *A45C 13/30* (2013.01); *A45C 2013/025* (2013.01)

(58) Field of Classification Search
CPC .. A45C 3/06; A45C 13/26; A45C 3/00; A45C 13/10; A45C 3/04
USPC ..... 150/107–118; D3/243, 244, 246, 303, D3/318; 383/37
See application file for complete search history.

(56) References Cited

U.S. PATENT DOCUMENTS

| | | | | | |
|---|---|---|---|---|---|
| 4,240,480 | A * | 12/1980 | Strobel | A45C 3/00 | 383/13 |
| 4,273,274 | A * | 6/1981 | Freistadt | A45F 3/04 | 150/108 |
| 4,679,671 | A * | 7/1987 | Kobayashi | A45C 5/14 | 150/107 |
| D508,320 | S * | 8/2005 | Holland | D3/303 | |
| D543,026 | S * | 5/2007 | Gonzalez | D3/243 | |
| D583,559 | S * | 12/2008 | Gonzalez | D3/243 | |
| D673,772 | S * | 1/2013 | Munson | D3/246 | |
| D778,605 | S * | 2/2017 | Slimane | D3/244 | |
| 2010/0092110 | A1* | 4/2010 | Simhony | A45C 13/30 | 383/13 |
| 2015/0257517 | A1* | 9/2015 | Holtz | A45F 4/02 | 224/645 |

OTHER PUBLICATIONS

"Molle—Modular Lightweight Load-carrying Equipment," Wikipedia, the free encyclopedia, Feb. 21, 2015, 4 pgs.

(Continued)

*Primary Examiner* — Fenn C Mathew
*Assistant Examiner* — Cynthia Collado
(74) *Attorney, Agent, or Firm* — Travis R. Banta; TechLaw Ventures, PLLC

(57) ABSTRACT

A carrying system includes a carrying device such as a bag, an attachment assembly such as one or more straps connected with the bag, and an item having a receiving element configured to receive a portion of a strap to thereby secure the item with the carrying device. In some examples the bag includes various attachment regions that provide locations on the interior and exterior of the bag for attaching multiple items. The bag further includes multiple interchangeable straps to provide the user with both functional and appearance choices in using the bag.

10 Claims, 11 Drawing Sheets

(56) References Cited

OTHER PUBLICATIONS

"Speed Clips," BlackHawk!, 2014, downloaded from http://blackhawk.com/products/accessories/accessories/clips/speed-clips, 8 pgs.
"Side Hydration Pouch," BlackHawk!, 2014, downloaded from http://blackhawk.com/products/tactical-nylon/equipment-pouches/speed-clip-mounted/hydration/side-hydration-pouch, 6 pgs.

* cited by examiner 10
19

67
69
69
15
69
67
10

17
10

BAG ATTACHMENT ASSEMBLY

PRIORITY

This application claims priority to U.S. Provisional Patent Application Ser. No. 62/162,941, filed May 18, 2015 entitled "Bag Attachment Assembly," the disclosure of which is incorporated by reference herein.

BACKGROUND

The devices and methods disclosed pertain to the field of containers, such as a bag for storing and carrying items.

Bags are often used to carry personal items while travelling or throughout day-to-day activities. Typically, bags include a large interior compartment with various arrangements of pockets, compartments, or closures around the large interior compartment to separate and organize items within the bag. Due to the convenience of a large interior compartment, items are often dropped into the large interior compartment, where the items can get tangled, jumbled within the bag, or held in a disorganized fashion within the large interior compartment. Further, electronic items, such as smart phones or tablets, can be damaged while stored in the large interior compartment. Thus, a bag attachment assembly for organizing and securing items within an interior compartment of a bag is desired.

While a variety of bag designs and compartments within bags have been made and used, it is believed that no one prior to the inventor has made or used the devices, systems, and methods as described herein. Other aspects, features, and techniques within the scope of the present disclosure will become more apparent to those of ordinary skill in the art from the following description taken in conjunction with the drawings.

Figure 1:
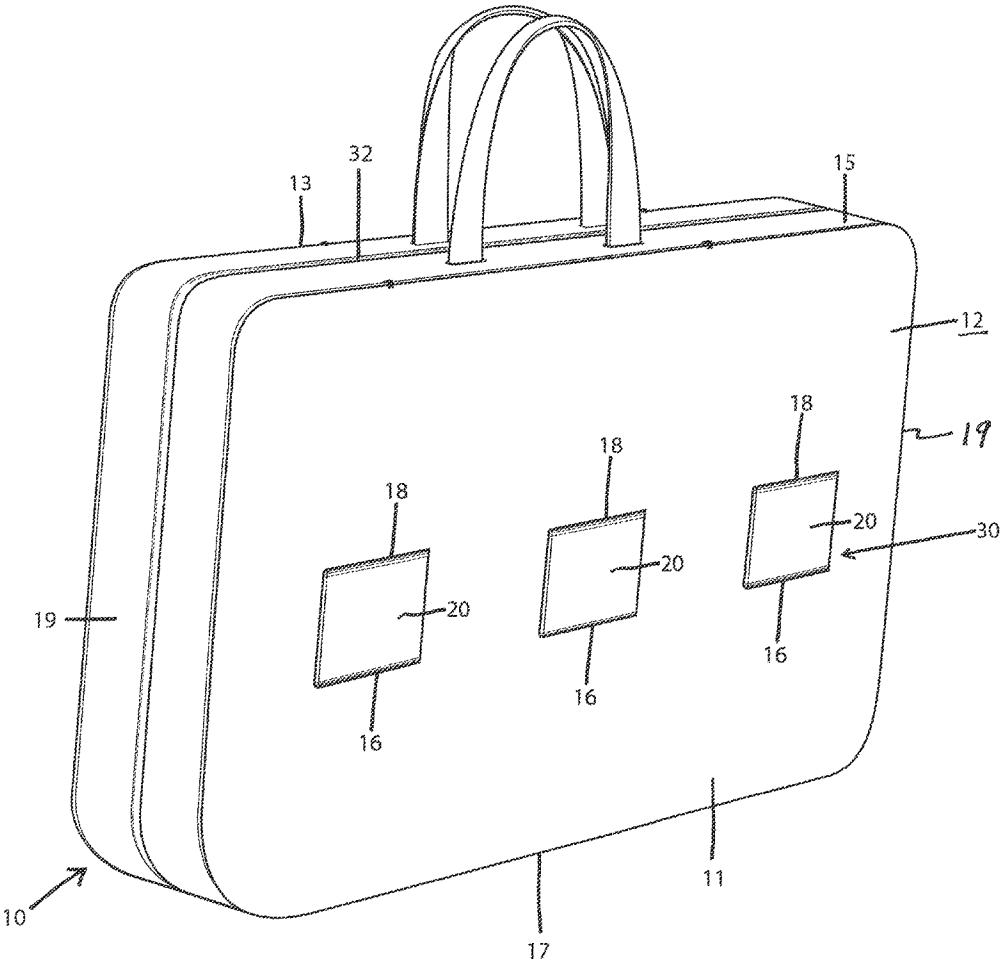
FIG. 1 depicts a perspective view of an exemplary bag having a bag attachment assembly.
Figure 2:
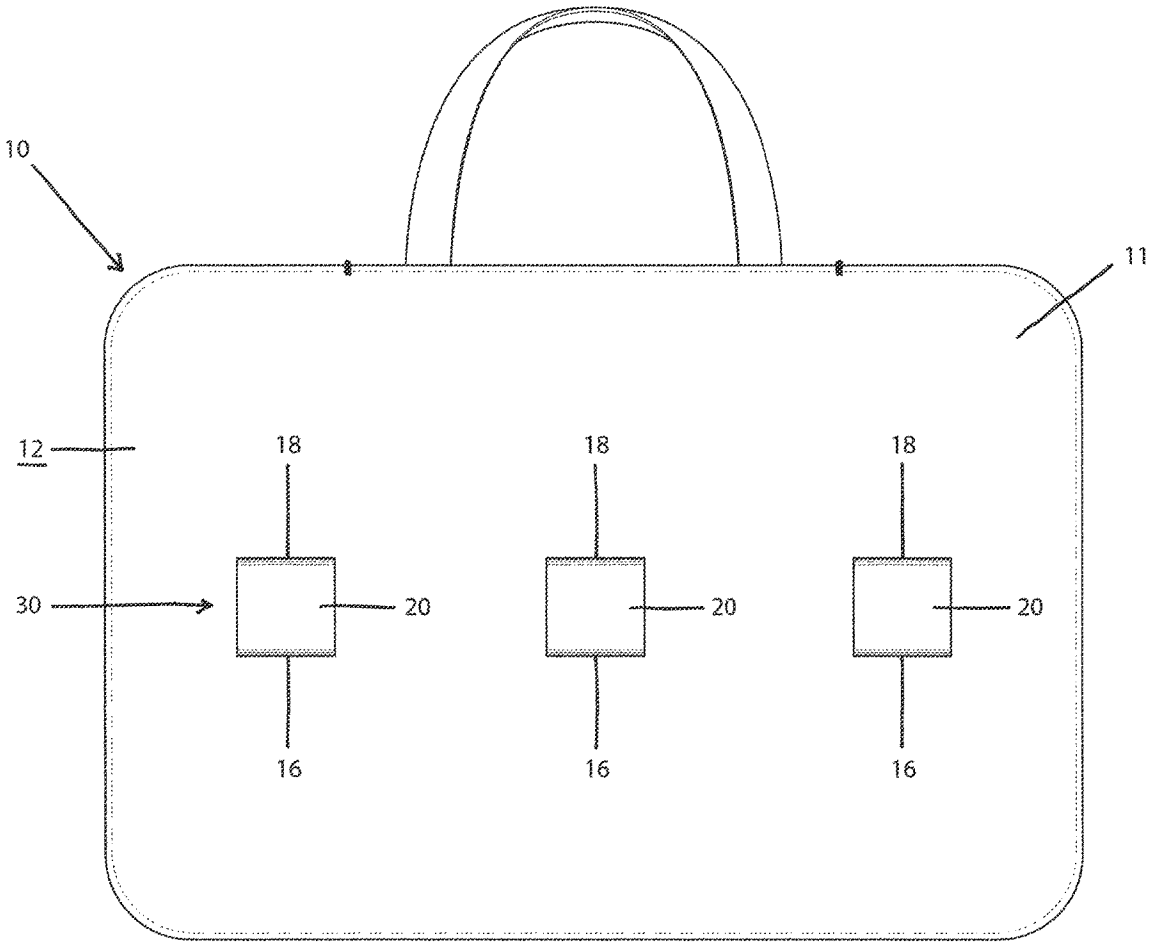
FIG. 2 depicts a front view of the bag of FIG. 1.

The drawings are not intended to be limiting in any way, and it is contemplated that various embodiments of the present disclosure may be carried out in a variety of other ways, including those not necessarily depicted in the drawings. The accompanying drawings incorporated in and forming a part of the specification illustrate several aspects, and together with the description serve to explain the principles of the present disclosure; it being understood, however, that the scope of the present disclosure is not limited to the precise arrangements shown.

DETAILED DESCRIPTION

The following description of certain embodiments should not be used to limit the scope of the present disclosure. Other examples, features, aspects, embodiments, and advantages will become apparent to those skilled in the art from the following description. As will be realized, various aspects of the present disclosure may take alternate forms, or have alternate or additional embodiments, without departing from the scope of the present disclosure. Accordingly, the drawings and descriptions should be regarded as illustrative in nature and not restrictive.

"Bag" as used herein means a device for carrying or storing items, and in some instances personal items. Non-limiting examples of bags include a purse, a handbag, a briefcase, a duffle bag, a carry-on bag, or a piece of luggage.

"Item" as used herein means an article being carried or stored in the bag. Non-limiting examples of items include a cell phone, tablet, laptop, audio headphones, or an umbrella, all of which may or may not be within a case or sleeve, and such cases and sleeves may be considered "items" as well.

Figure 5:
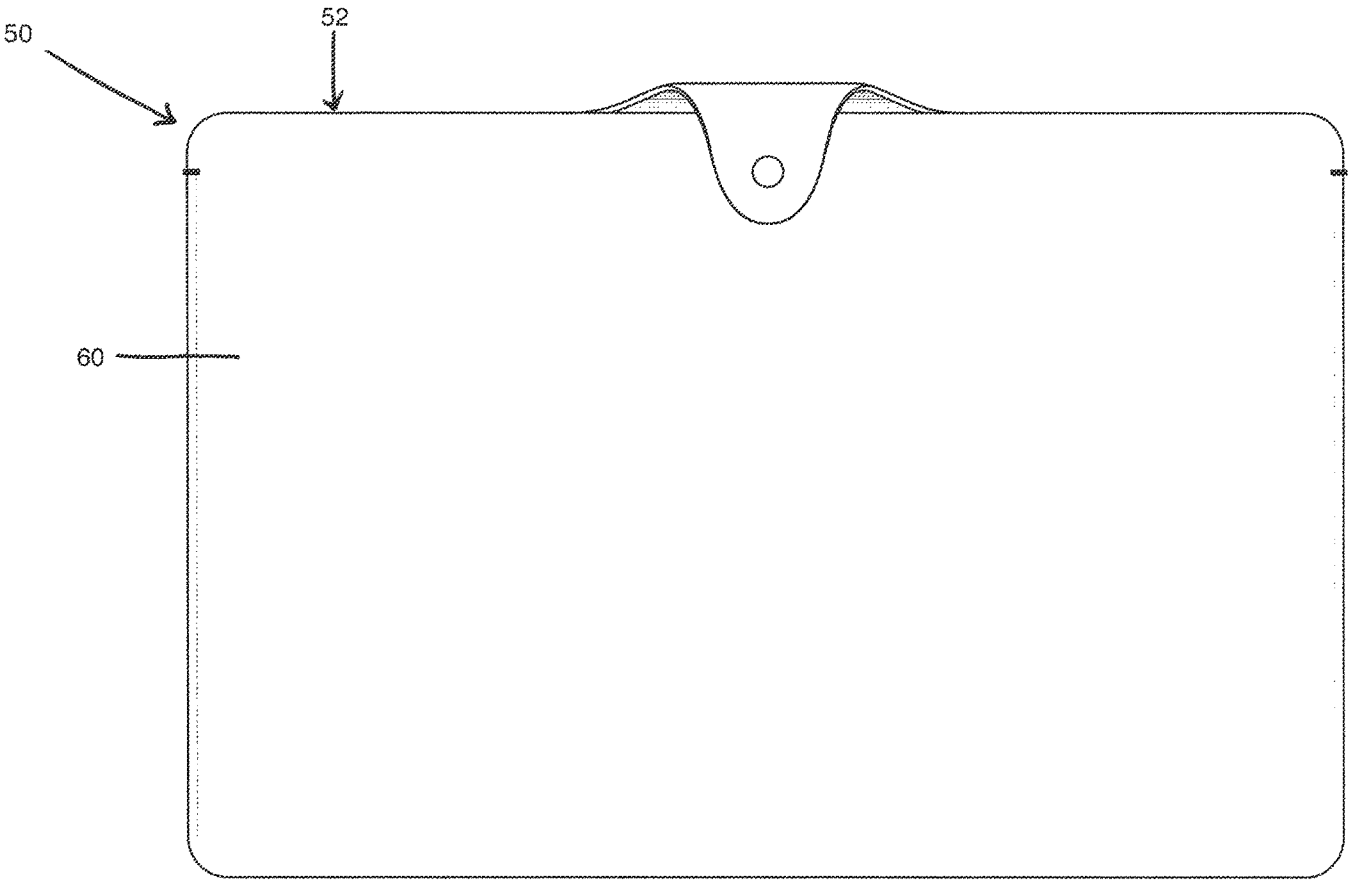
FIG. 5 depicts a front view of the case of FIG. 4.
Figure 6:
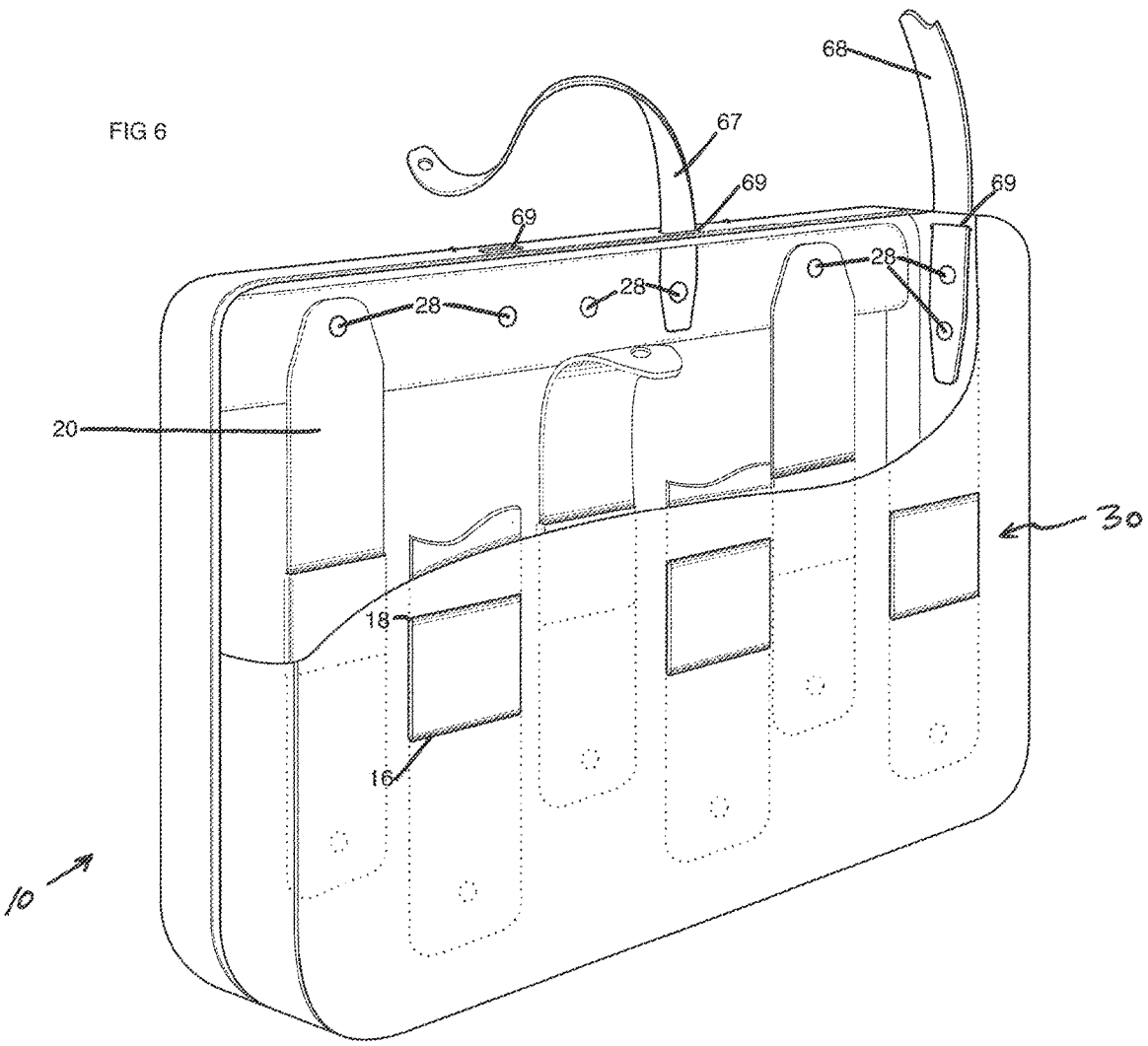
FIG. 6 depicts a perspective view of the bag of FIG. 1, shown with a portion of the bag exterior removed to reveal interior features, and having a detachable handle strap and a carrying strap.
Figures 7, 8, 9:
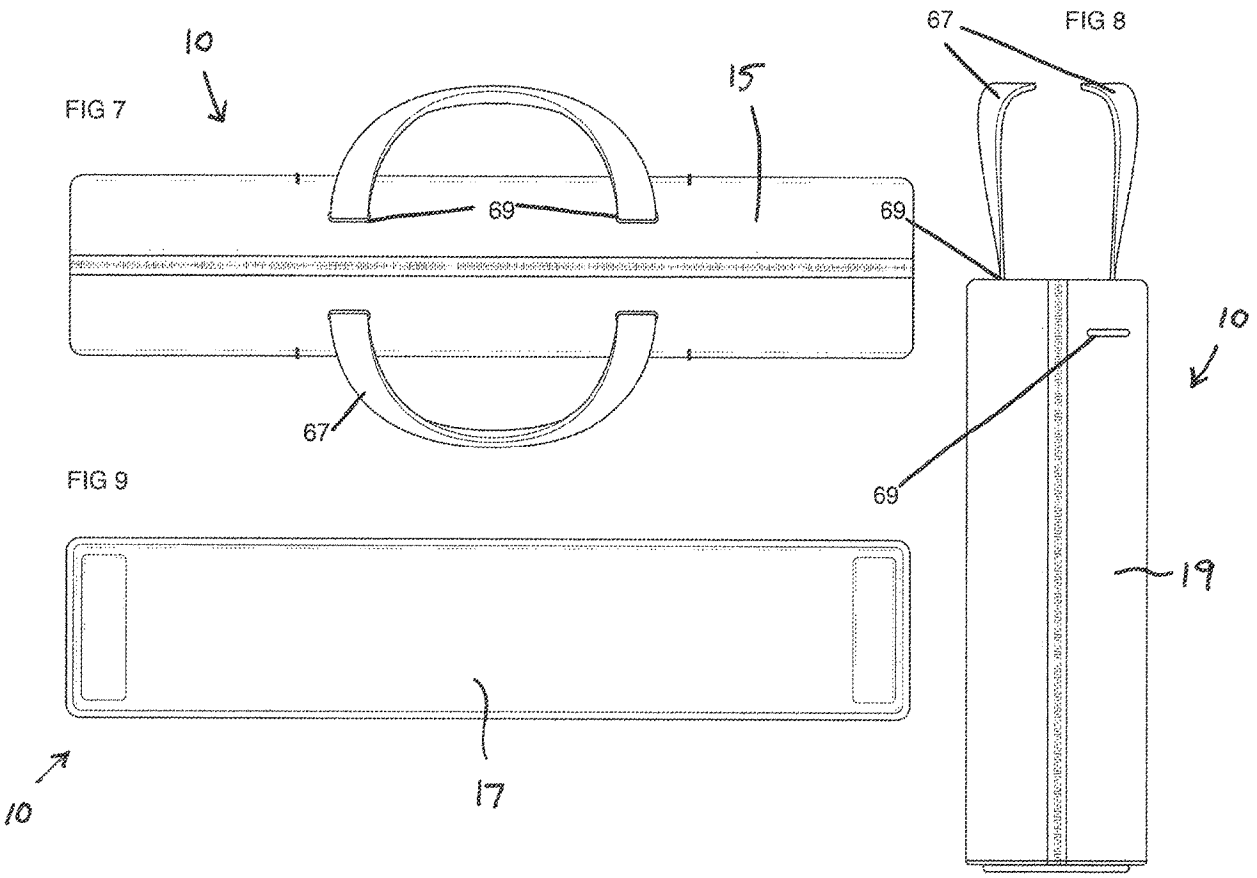
FIG. 7 depicts a top view of the bag of FIG. 6.
FIG. 8 depicts a side view of the bag of FIG. 6.
FIG. 9 depicts a bottom view of the bag of FIG. 6.

FIG. 1 shows an exemplary bag attachment assembly (30) for securing an item (50), as shown in FIG. 5, with an exemplary bag (10). As shown in FIG. 1, the bag (10) comprises an outer surface (12) having a front (11), a back (13), a top (15), a bottom (17), and opposing sides (19). In the illustrated embodiment, an opening (32) extends from the top (15) to the sides (19) and allows the bag (10) to be opened. Accordingly, the front (11), the back (13), the top (15), the bottom (17), and the opposing sides (19) form an interior compartment (34) with an inner surface (14) of the bag (10) that can be accessed through the opening (32). This allows at least one item (50) to be stored within the interior compartment (34) of the bag (10). The bag (10) further comprises a plurality of slots (16, 18) on the front (11) and the back (13) that extend from the outer surface (12) to the inner surface (14). These slots (16, 18) will be discussed in more detail below. The bag (10) can be made of textile materials, such as leather, suede, fabric, etc., or non-textile materials, such as plastic, etc.

Figure 3:
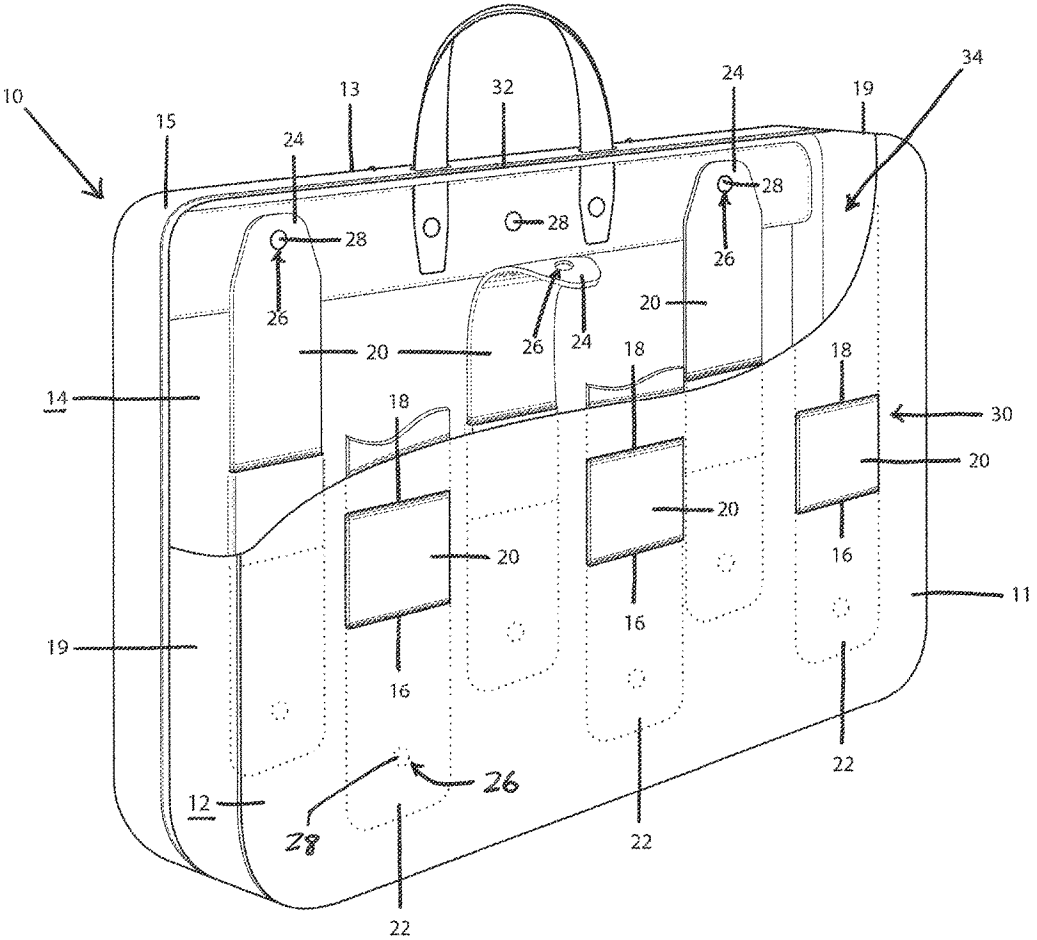
FIG. 3 depicts a perspective view of the bag of FIG. 1 shown with a portion of the bag exterior removed to reveal interior features.

As best seen in FIG. 3, the bag (10) comprises a bag attachment assembly (30) comprising at least one strap (20). Each strap (20) has a bottom end (22) and top end (24) that extend along the front (11) and/or the back (13) of the bag (10). In the illustrated version, a total of six straps (20) are shown. In other versions, there may be greater than or fewer than six straps (20). In other versions, the straps (20) may extend such that the bottom end (22) of one strap (20) can connect with the bottom end (22) of an opposing strap (20) to form a larger strap (20) that may serve both the front (11) and the back (13) of the bag (10). In the present example, the straps (20) are removable from the bag (10), while in some other versions the straps (20) may be non-removable from the bag (10). In those versions where the straps (20) are non-removable from the bag (10), the straps (20) may be secured to portions of the bag (10) by way of thread, adhesives, studs, or other suitable fasteners. In view of the teachings herein, other ways to configure straps (20) will be apparent to those of ordinary skill in the art.

The strap (20) is sufficiently flexible to thread through the slots (16, 18). For instance, the strap (20) can be made of leather, suede, or other textile or non-textile materials. The strap (20) can be about 1½ inches wide, but other suitable dimensions can be used as will be apparent to those of skill in the art in view of the present disclosure. The slots (16, 18) are then sized to receive the strap (20). As shown in FIG. 3, the strap (20) is positioned through slots (16, 18) to tether the strap (20) with either the front (11) or the back (13) of the bag (10). As such, the strap (20) is inserted within the lower slot (16) to pass from the inner surface (14) of the bag (10) to the outer surface (12) of the bag (10). The strap (20) is then inserted within the upper slot (18) to pass back from the outer surface (12) of the bag (10) to the inner surface (14) of the bag (10). In some embodiments, the ends (22, 24) of the strap (20) are tapered and/or chamfered to allow for easier insertion within the slots (16, 18) or through strap receiving elements (62) of items (50) as will be discussed further below.

The top ends (24) and bottom ends (22) of the strap (20) comprises engaging features depicted as slots (26) that are aligned with corresponding fasteners depicted as rivets (28) on the inner surface (14) of the bag (10). The rivets (28) are thereby insertable within the slots (26) to selectively couple the top end (24) and bottom end (22) of the strap (20) with the inner surface (14) of the bag (10). Of course, other suitable ways and configurations for selectively coupling the top end (24) and bottom end (22) of the strap (20) to the inner surface (14) of the bag (10) will be apparent to one with ordinary skill in the art in view of the teachings herein. For instance, the top end (24) and/or bottom end (22) of the strap (20) can be coupled with the inner surface (14) of the bag (10) by magnets, Velcro, buttons, snaps, or any other suitable fastening structures.

Figure 4:
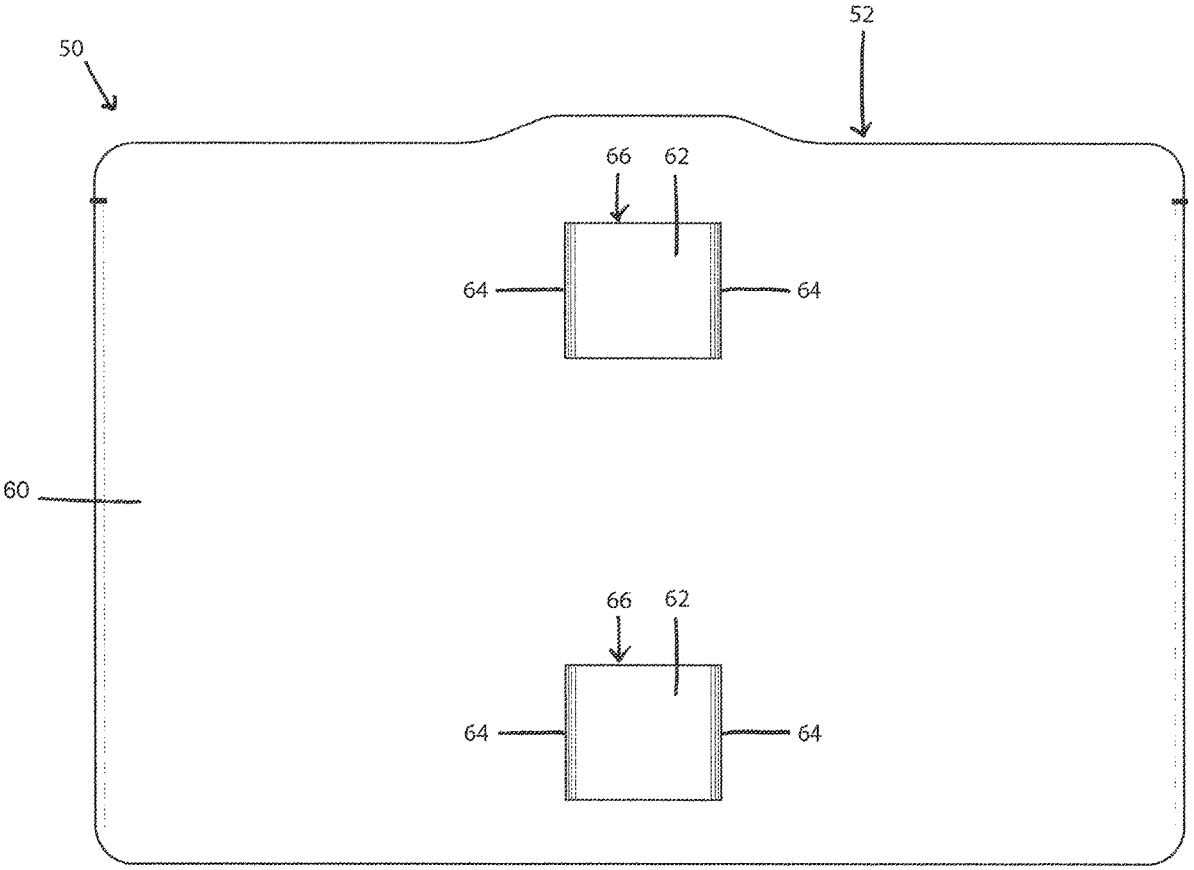
FIG. 4 depicts a back view of an exemplary case for use with the bag attachment assembly of FIG. 1.

Referring now to FIGS. 4 and 5, an item (50) is shown that can be selectively coupled with the bag (10) via the bag attachment assembly (30) (sometimes also referred to as a carrying system or attachment assembly). In the present embodiment, the item (50) comprises a case that forms a pocket with an opening (52). The case is configured to receive a cell phone, tablet, laptop, etc., within the pocket through the opening (52). In some versions, the case or item (50) can include a zipper closure instead of the depicted flap closure.

An outer surface (60) of the case comprises at least one strap receiving element (62). As shown in FIG. 5, the strap receiving element (62) of the present embodiment comprises a strap that is sewn at either side (64) of the outer surface (60) of the case to form an opening (66). Of course, other suitable configurations for the strap receiving element (62) will be apparent to one with ordinary skill in the art in view of the teachings herein. For example, in some versions, strap receiving elements (62) may be open and re-sealable such that strap receiving elements (62) can attach with a strap (20) by opening, wrapping around the strap (20), and then re-sealing or closing. This opening, re-sealing, and/or closing can be accomplished by configuring the strap receiving elements (62) and items (50) with suitable fasteners, e.g. hook and loop or magnetics fasteners, etc. Each opening (66) is sized to correspond with a width of the strap (20) of the bag (10). Accordingly, in the present example where the strap receiving element (62) is sewn on the sides to the item (50), the strap (20) is threaded through the opening (66) of the item (50) to secure the item (50) with the bag (10).

By way of example only, a user can release the top end (24) of a strap (20) from a rivet (28) on the inner surface (14) of the bag (10), as shown in FIG. 3. The user can then unthread the strap (20) from the slots (16, 18) of the bag (10). This releases the strap (20). The item (50) can be positioned within the interior compartment (34) of the bag (10) to align a strap receiving element (62) with the strap (20). The top end (24) of the strap (20) is threaded through the opening (66) of the strap receiving element (62). The top end (24) of the strap (20) can then be threaded through the lower slot (16) to the exterior of the bag (10). This secures the item (50) to the bag (10) at the strap receiving element (62).

The strap (20) can further be threaded through the upper slot (18) back to the inner surface (14) of the bag (10). From here, the strap (20) can either be threaded through another strap receiving element (62) or the strap (20) can be coupled to the bag (10) by positioning the slot (26) of the strap (20) onto the rivet (28). For instance, the strap (20) can be threaded to another strap receiving element (62) of the same item (50) to provide additional securement of the item (50) with the bag. Alternatively, the strap (20) can be threaded to a strap receiving element (62) of another item (50) such that the strap (20) can secure a plurality of items (50) to the bag (10). With the item (50) attached to the bag (10), the weight of the item (50) can be more distributed throughout the bag (10). Further, by using the bag attachment assembly (30), the interior compartment (34) is restored to the full capacity when the item (50) is removed without the need for other inconvenient compartments or pockets within the bag (10), however, other compartments or pockets may be used if desired. Also, with the bag attachment assembly (30) as described, the bag (10) is provided with interchangeable and moveable pockets and/or storage by the ability to move items (50) within the bag (10) and to selectively secure them within the bag (10) at various locations along the bag attachment assembly (30).

In another example of attaching an item (50) with the bag (10), a user can release the top end (24) of a strap (20) from a rivet (28) on the inner surface (14) of the bag (10), as shown in FIG. 3. The user can then position the item (50) within the interior compartment (34), align a strap receiving element (62) of the item (50) with the strap (20), and then thread the strap (20) through the strap receiving element (62) of the item (50). Once threaded in this manner, the top end (24) of the strap (20) is connected again with the rivet (28) by way of the slot (26) within the top end (24) of the strap (20). In this manner, it is not required to unthread the strap (20) from slots (16, 18) to attach an item (50) with the bag (10). With the bottom end (22) of the strap (20) configured similarly to the top end (24), the same procedure can be used to attach an item (50) with the bag (10). Again, it not being required to unthread the strap (20) from slots (16, 18) to attach an item (50) with the bag (10).

Figure 12:
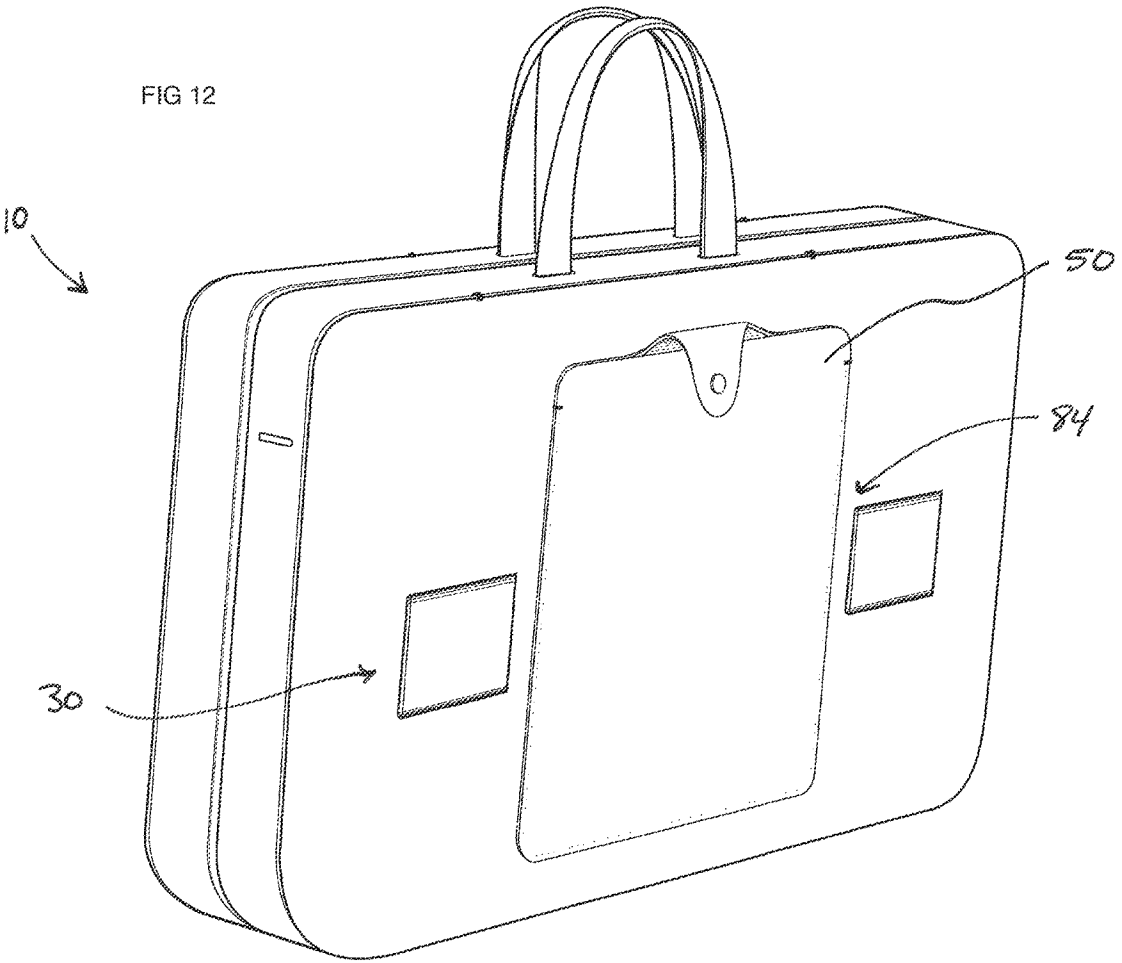
FIG. 12 depicts a perspective view of the bag of FIG. 6 with one exemplary case attached to the exterior.

Additionally or alternatively, the strap (20) can be used to attach an item (50) to the outer surface (12) of the bag (10) as illustrated in FIG. 12. Here, the strap (20) is threaded through the lower slot (16) of the bag (10) to the outer surface (12). The strap (20) is then threaded through a strap receiving element (62) of an item (50) and back through the upper slot (18) of the bag (10) to the inner surface (14). Accordingly, each strap (20) can secure three items (50) in the present embodiment: two on the inner surface (14) and one on the outer or exterior surface (12). Therefore, in the illustrated version having six straps (20), the bag (10) can secure up to a total of eighteen items (50). In view of the teachings herein, various ways to modify the straps (20)

and/or the number of straps (20) used with the bag (10) will be apparent to those of ordinary skill in the art. For instance, the present embodiment shows six straps (20) that extend along the front (11) and the back (13) of the bag (10), but any other suitable number of straps (20) can be used. The straps (20) can also be positioned on other portions of the bag (10), such as the bottom (17), the top (15), or the sides (19). Also, the number of items (50) that can be secured with the strap (20) can vary depending on the length of the strap (20) and size of the interior compartment (34) of the bag (10). Moreover, the configuration of slots (16, 18) can be modified such that more than one row of slots (16, 18) can be included along one or each of the front (11) and back (13) of the bag (10). In view of the teachings herein, various bag sizes and shapes, as well as various alternate configurations for the straps (20) and slots (16, 18) will be apparent to those of ordinary skill in the art.

The present embodiment further shows the straps (20) extending along the front (11) and the back (13) of the bag (10) vertically in a parallel configuration. The straps (20) can vary in length to extend along a larger or smaller portion of the bag (10) as mentioned. In other embodiments, the straps (20) may extend along the front (11) continuing to the back (13) of the bag (10) or from one side (19) of the bag (10) to the other side (19) such that the straps would extend generally perpendicular to what is depicted in FIG. 3 for example.

In some embodiments, the straps (20) are positioned on the outer surface (12) of the bag (10) in addition to or instead of the inner surface (14). For instance, in some embodiments the terminal fastening member, i.e. rivet, stud, button, etc. may be located on the outside surface of the bag. In some embodiments, the straps (20) are configured to thread through another bag (10) having slots (16, 18) to secure multiple bags (10) together. In some other embodiments, the strap (20) is wrapped around the item (50) such that a strap receiving element (62) is not needed. In other embodiments, an item (50) may be used without a bag (10) and carried with a strap utilizing a strap receiving element (62).

FIGS. 6-9 depict the bag (10) modified to include an optional carrying strap (68). As seen and understood from FIG. 6, bag (10) may further include slots (69) on each side of the bag. Slots (69) are configured to receive ends of carrying strap (68). Each end of carrying strap (68) includes engaging features similar to slots (26) of straps (20). These engaging features or slots on carrying strap (68) are configured to engage with rivets (28) that are positioned within the interior compartment (34) of the bag (10) to thereby connect the carrying strap (68) with the bag (10). In the reverse manner, carrying strap (68) is detachable from the bag (10) such that it may be removed altogether or replaced by another carrying strap of different size, pattern, etc. Such interchangeability of carrying straps can be driven by function depending on the bag (10) load, or it may be driven based on user preference and/or desired style.

Similar to carrying strap (68), as shown in FIGS. 6-9, the bag (10) also includes slots (69) in the exterior of the bag (10) near a handle strap (67) of the bag (10). The handle strap (67) is selectively attachable or connectable with the bag (10) in the same manner as the carrying strap (68) described above. For instance, the ends of the handle strap (67) include engaging features similar to slots (26) of straps (20). These engaging features or slots on the handle strap (67) are configured to engage with rivets (28) that are positioned within the interior compartment (34) of the bag (10) to thereby connect the handle strap (67) with the bag (10). In the reverse manner, the handle strap (67) is detachable from the bag (10) such that it may be removed altogether or replaced by another handle strap of different size, pattern, etc. Such interchangeability of handle straps can be driven by function depending on the bag (10) load, or it may be driven based on user preference and/or desired style. Carrying strap (68) and handle strap (67) are configured to aid in carrying the bag (10) and additionally can be used for attaching other items (50) through strap receiving elements (62). In view of the teachings herein, other configurations for and ways for attaching and detaching the carrying strap (68) and handle strap (67) will be apparent to those of ordinary skill in the art.

Similar to the detachability and interchangeability of the handle strap (67) and carrying strap (68), the attachment straps (20) are also detachable and interchangeable in some versions. Thus in the present example, the combined handle strap (67), carrying strap (68), and attachment straps (20) can all be detached and replaced with other similar components that have either different colors, patterns, physical properties, etc.

Additionally, with the bag (10) as shown, the hardware for attaching the handle strap (67) and/or carrying strap (68) is located within the bag (10). Thus in the present example the bag (10) is provided without external hardware, and instead all the hardware for both the attachment straps (20) as well as the handle strap (67) and carrying strap (68) are concealed by being located within the interior of the bag (10).

Figure 10:
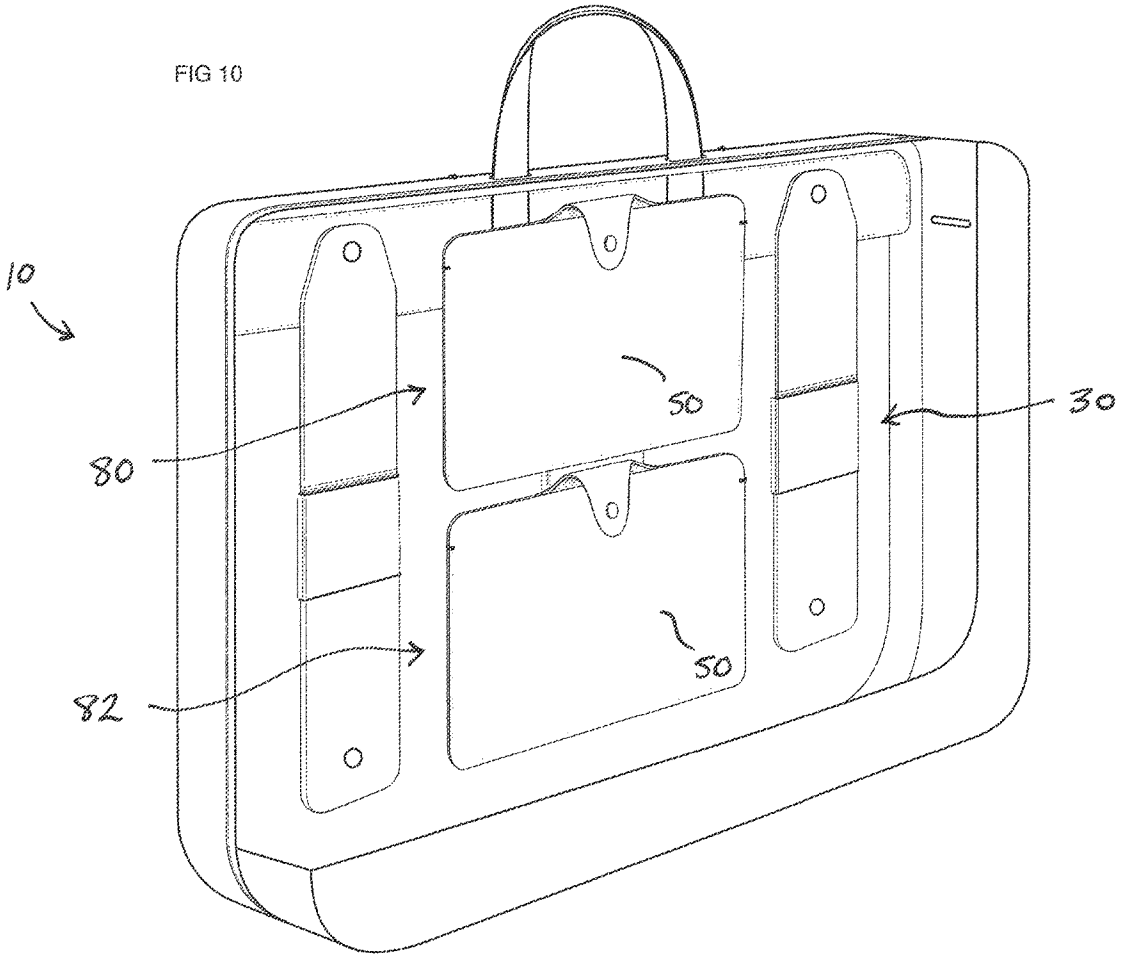
FIG. 10 depicts a perspective view of the bag of FIG. 6, with one side of the bag partially removed to reveal interior features, including two exemplary cases attached.

FIG. 10 illustrates an exemplary configuration for the bag (10) with two items (50) connected with the bag (10). As shown, the bag attachment assembly (30) defines both upper attachment region (80) and lower attachment region (82). In the present example, a first item (50) is secured within the upper attachment region (80) closest to the handle strap (67), and a second item (50) is secured within the lower attachment region (82). The bag (10) further includes a central attachment region (84) as shown in FIG. 12. In the present example, the upper and lower attachment regions (80, 82) are located on the interior of the bag (10) while the central attachment region (84) is located on the exterior of the bag (10). In view of the teachings herein, other ways to modify the configuration of the attachment regions (80, 82, 84) will be apparent to those of ordinary skill in the art.

Figure 11:
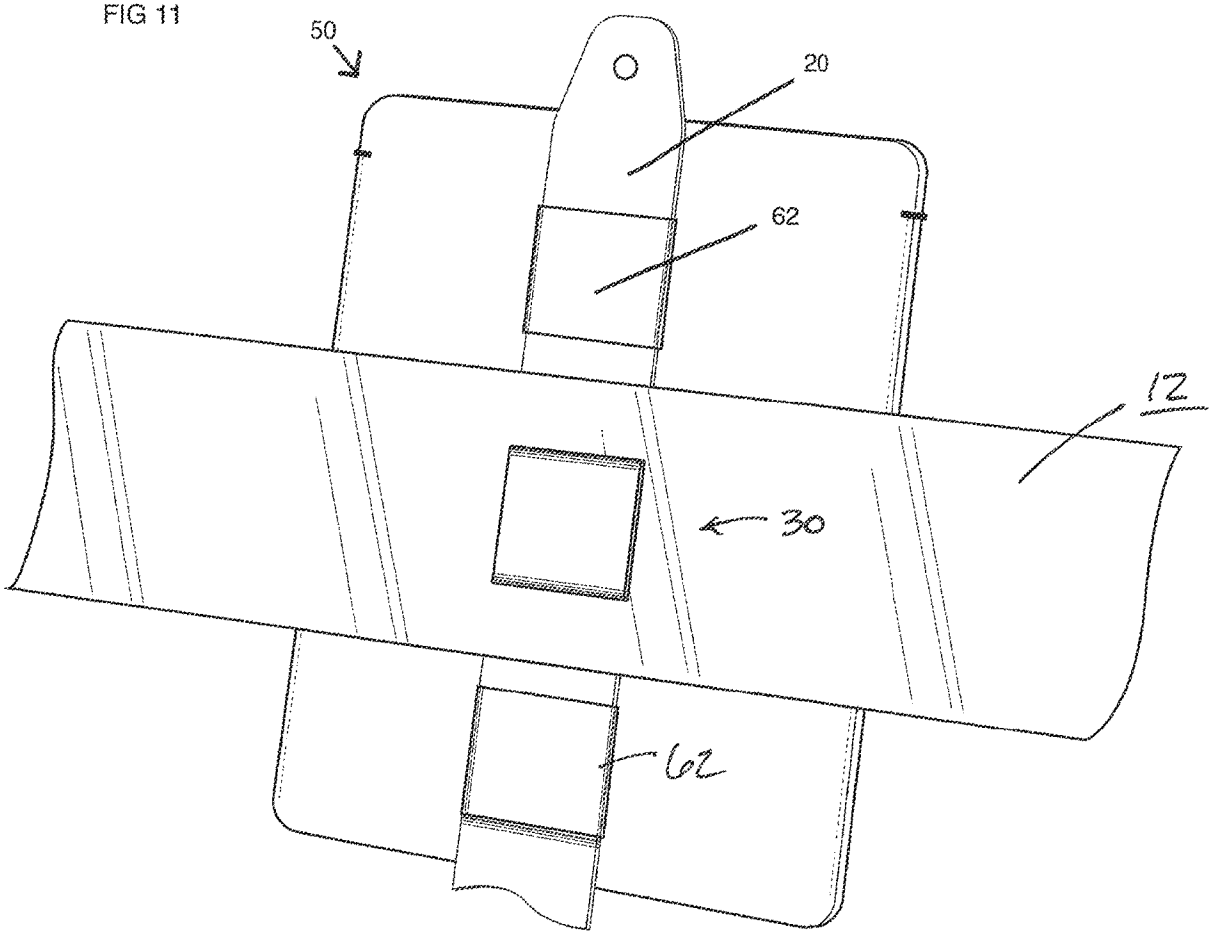
FIG. 11 depicts a partial view of an interior portion of the bag of FIG. 6, showing features of the bag attachment assembly used with another exemplary case having a single row of strap receiving elements.
Figure 13:
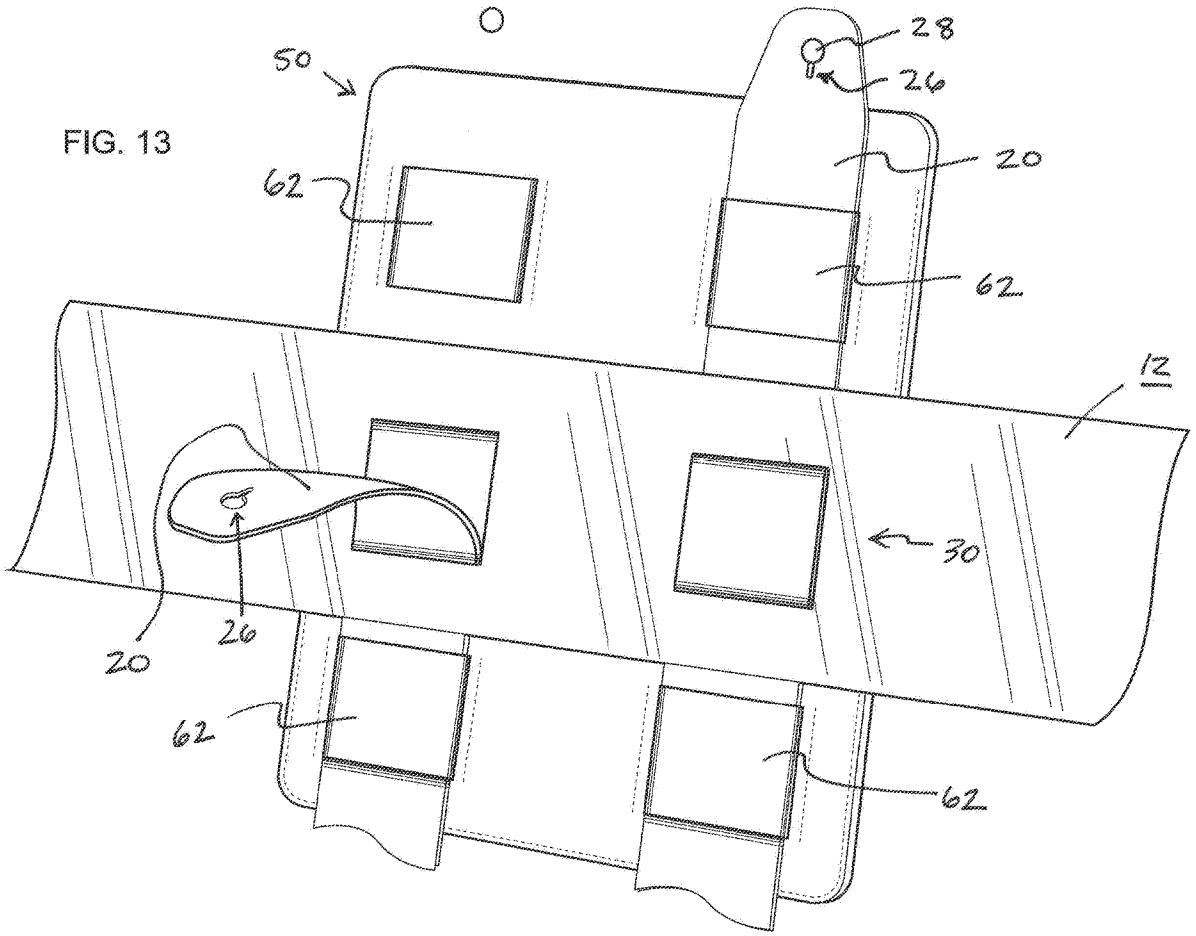
FIG. 13 depicts a partial view of an interior portion of the bag of FIG. 6, showing features of the bag attachment assembly used with another exemplary case having multiple rows of strap receiving elements.

FIG. 11 illustrates an exemplary item (50) in the form of a case. In the present example, item (50) comprises two strap receiving elements (62) that are arranged longitudinally along a center portion of the item (50). As described above, the strap (20) is operable to be threaded through one or more of the strap receiving elements (62) to secure the item (50) with the bag (10). Referring to FIG. 13, another exemplary item (50) is shown, also in the form of a case. In this example, the item (50) comprises four strap receiving elements (62) that are arranged longitudinally along the item (50) in two columns. With this arrangement, multiple side-by-side straps (20) may be used to secure the item (50) with the bag (10). While FIGS. 11 and 13 illustrate strap receiving elements (62) arranged longitudinally along respective items (50), in other versions strap receiving elements (62) may be arranged transversely across respective items (50). In view of the teachings herein, other arrangements and configurations for the strap receiving elements (62) will be apparent to those of ordinary skill in the art.

It should be understood that any one or more of the teachings, expressions, embodiments, examples, etc. disclosed herein may be combined with any one or more of the other teachings, expressions, embodiments, examples, etc. that are disclosed herein. The teachings, expressions, embodiments, examples, etc. disclosed herein should therefore not be viewed in isolation relative to each other. Various suitable ways in which numerous aspects of the present disclosure may be combined will be readily apparent to those of ordinary skill in the art in view of the teachings disclosed herein. Such modifications and variations are intended to be included within the scope of both the present disclosure and the claims.

Having shown and described various embodiments of the present disclosure, further adaptations of the methods and systems described herein may be accomplished by appropriate modifications by one of ordinary skill in the art without departing from the scope of the present disclosure. Several of such potential modifications have been mentioned, and others will be apparent to those skilled in the art. For instance, examples, embodiments, geometrics, materials, dimensions, ratios, steps, and the like discussed above are illustrative and are not required. Accordingly, the scope of the present disclosure should be considered in terms of the following claims and is understood not to be limited to the details of structure and operation shown and described in the specification and drawings.

I claim:

1. A carrying system for a carrying device, wherein the carrying system is configured to selectively secure one or more items with the carrying device, wherein the carrying system comprises:

(a) a strap having a first end selectively connected with the carrying device;

(b) a pair of slots within the carrying device, wherein each of the slots provide access from an interior of the carrying device to an exterior of the carrying device, wherein the pair of slots is configured to threadably receive the strap;

(c) a first fastener fixedly connected with the carrying device, wherein the first fastener allows selective attachment of the first end of the strap with the first fastener; and (d) an upper attachment region, a lower attachment region, and a central attachment region, wherein the upper attachment region and the lower attachment region are located along the interior of the carrying device, and wherein the central attachment region is located along the exterior of the carrying device.

2. The carrying system of claim 1, further comprising a receiving element fixedly connected with the item and configured to receive the strap.

3. The carrying system of claim 2, wherein the strap threads through the receiving element.

4. The carrying system of claim 1, wherein the strap further comprises a second end selectively connected with the carrying device.

5. The carrying system of claim 4, further comprising a second fastener fixedly connected with the carrying device, wherein the second fastener allows selective attachment of the second end of the strap with the second fastener.

6. A bag for carrying one or more items, wherein the bag comprises:

(a) an exterior surface;

(b) an interior compartment defined by an interior surface;

(c) at least one first slot formed in the exterior surface of the bag and providing access to the interior compartment;

(d) at least one second slot formed in the exterior surface of the bag and providing access to the interior compartment;

(e) at least one attachment strap selectively connected to the interior surface of the bag at respective ends of the at least one attachment strap, wherein the at least one attachment strap is configured to secure the one or more items with the bag, wherein the at least one attachment strap is threaded through the at least one first slot and the at least one second slot to thereby expose a portion of the at least one strap along the exterior surface of the bag;

(f) at least one fastener located within the interior compartment and configured to engage with the at least one strap;

(g) a handle strap, wherein the handle strap is selectively connected to the interior surface of the bag; and (h) a carrying strap, wherein the carrying strap is selectively connected to the interior surface of the bag.

7. The device of claim 6, wherein each of the at least one attachment strap, the handle strap, and the carrying strap are removable from the bag.

8. The device of claim 6, wherein the one or more items comprise a strap receiving element configured to engage with the at least one attachment strap to selectively secure the one or more items with the bag.

9. The device of claim 8, wherein the one or more items are selectively secured to the interior compartment of the bag.

10. The device of claim 8, wherein the one or more items are selectively secured to the exterior surface of the bag.

* * * * *